US008452643B2

(12) United States Patent
Spannagl

(10) Patent No.: US 8,452,643 B2
(45) Date of Patent: May 28, 2013

(54) METHOD FOR DETECTING VEHICLES WITH TRAILERS

(75) Inventor: Peter Spannagl, Krems (AT)

(73) Assignee: Kapsch Trafficcom AG, Wien (AT)

( * ) Notice: Subject to any disclaimer, the term of this patent is extended or adjusted under 35 U.S.C. 154(b) by 120 days.

(21) Appl. No.: 13/044,314

(22) Filed: Mar. 9, 2011

(65) Prior Publication Data

US 2011/0246263 A1 Oct. 6, 2011

(30) Foreign Application Priority Data

Apr. 2, 2010 (EP) ..... 10450053

(51) Int. Cl.
*G07B 15/00* (2011.01)
*G08B 21/00* (2006.01)

(52) U.S. Cl.
USPC ..... 705/13; 340/431

(58) Field of Classification Search
USPC ..... 705/13; 340/988, 431, 933; 701/521
See application file for complete search history.

(56) References Cited

U.S. PATENT DOCUMENTS

| | | | | |
|---|---|---|---|---|
| 3,906,442 | A * | 9/1975 | Mosteller | 340/431 |
| 5,717,390 | A | 2/1998 | Hasselbring | |
| 5,913,180 | A * | 6/1999 | Ryan | 702/45 |
| 5,936,517 | A * | 8/1999 | Yeh | 340/435 |
| 6,140,941 | A * | 10/2000 | Dwyer et al. | 340/928 |
| 6,538,580 | B2 * | 3/2003 | Bostrom et al. | 340/933 |
| 6,720,888 | B2 * | 4/2004 | Eagleson et al. | 340/905 |
| 7,307,514 | B2 * | 12/2007 | McAden | 340/431 |
| 7,783,507 | B2 * | 8/2010 | Schick et al. | 705/7.11 |
| 8,280,617 | B2 * | 10/2012 | Young et al. | 701/119 |
| 2003/0233189 | A1 * | 12/2003 | Hsiao et al. | 701/207 |
| 2004/0124977 | A1 * | 7/2004 | Biffar | 340/539.13 |
| 2005/0226201 | A1 * | 10/2005 | McMillin | 370/348 |
| 2006/0064345 | A1 * | 3/2006 | Biet | 705/13 |
| 2006/0200379 | A1 * | 9/2006 | Biet | 705/13 |
| 2007/0241869 | A1 * | 10/2007 | Kalous | 340/431 |
| 2008/0068164 | A1 * | 3/2008 | Campbell | 340/572.1 |
| 2008/0195428 | A1 * | 8/2008 | O'Sullivan | 705/6 |
| 2009/0072956 | A1 * | 3/2009 | Kalous | 340/431 |
| 2009/0085796 | A1 * | 4/2009 | Kuroda et al. | 342/129 |
| 2009/0115638 | A1 * | 5/2009 | Shankwitz et al. | 340/988 |
| 2009/0144109 | A1 * | 6/2009 | Knight | 705/7 |
| 2009/0306861 | A1 * | 12/2009 | Schumann et al. | 701/48 |
| 2009/0313096 | A1 * | 12/2009 | Kaga | 705/13 |
| 2010/0201505 | A1 * | 8/2010 | Honary et al. | 340/425.5 |

(Continued)

FOREIGN PATENT DOCUMENTS

| | | | |
|---|---|---|---|
| CH | 690042 | * | 3/2000 |
| JP | 2008158874 | * | 7/2008 |

OTHER PUBLICATIONS

Extended European Search Report for corresponding European Patent Application No. 10 450 053.3, dated Sep. 15, 2010, 4pp.

*Primary Examiner* — Brian Epstein
(74) *Attorney, Agent, or Firm* — Christie, Parker & Hale, LLP.

(57) ABSTRACT

A method for detecting vehicles with trailers in a road toll system, which comprises at least one radio beacon for radio communication with radio OBUs, wherein vehicles and trailers are respectively provided with their own OBUs carried by them, and a vehicle and a trailer are detected as belonging to one another when an evaluation of the radio communications with their OBU indicates that these are moving at a limited and constant distance from one another.

20 Claims, 1 Drawing Sheet

U.S. PATENT DOCUMENTS

2010/0223090 A1* 9/2010 Lozito ..... 705/9
2011/0060600 A1* 3/2011 Fox et al. ..... 705/1.1
2011/0137773 A1* 6/2011 Davis et al. ..... 705/34
2011/0208568 A1* 8/2011 Deitiker et al. ..... 705/13

* cited by examiner

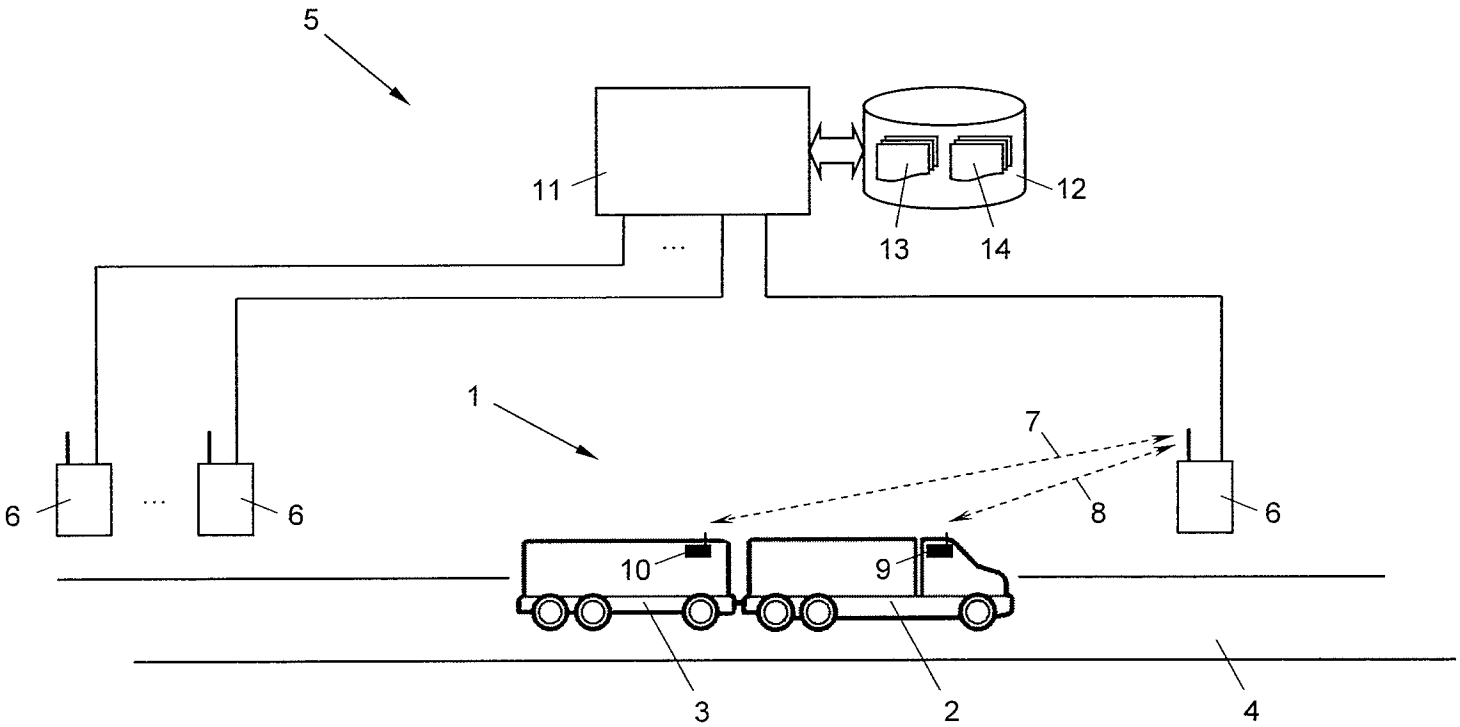
5
11
12
13
14
1
7
8
6
6
6
9
10
2
3
4

METHOD FOR DETECTING VEHICLES WITH TRAILERS

CROSS-REFERENCE TO RELATED APPLICATION(S)

This application claims priority to European Patent Application No. 10 450 053.3, filed on Apr. 2, 2010, the contents of which are hereby expressly incorporated by reference.

FIELD OF THE INVENTION

The present invention relates to a method for detecting vehicles with trailers in a road toll system that comprises at least one radio beacon for radio communication with radio onboard units (OBUs).

BACKGROUND

Road toll systems for charging tolls for vehicles by means of roadside radio beacons that communicate with onboard units (OBUs) on the vehicle side in order to identify and locate these are known. However, it is often necessary to detect the presence of a trailer, since this determines the extent of the toll. Conventionally, to detect the presence of a trailer, either the number of axles is determined in order to deduce the presence of a road train with trailers from a specific number of axles, or the presence of a trailer must be manually input by the user at the OBU of the vehicle. The latter requires complex systems for counting axles such as laser scanners or induction loops in the road surface, the latter being prone to error and manipulation.

SUMMARY

The present invention provides a method for detecting vehicles with trailers, which is simpler and more reliable than the known solutions. In some embodiments of the present invention, the vehicles and trailers have their own onboard unit (OBU) carried by them. A vehicle and a trailer are detected as belonging to one another when an evaluation of the radio communications with their OBUs indicates that the vehicle and the trailer are moving at a limited and constant distance from one another.

In some embodiments, the present invention is a method for detecting vehicles with trailers in a road toll system, which comprises at least one radio beacon for radio communication with OBUs. The method includes: providing a vehicle with a vehicle OBU carried by the vehicle; providing a trailer with a trailer OBU; and detecting that said vehicle and said trailer as belonging to one another, when an evaluation of radio communications with the vehicle OBU and the trailer OBU indicates that said OBUs are moving at a limited and constant distance from one another.

In some embodiments, the phase shift, the amplitude difference, or a Doppler shift between the two radio communications for measurement of a distance between the vehicle OBU and the trailer OBU may be utilized for said evaluation.

BRIEF DESCRIPTION OF THE DRAWINGS

FIG. 1 is an exemplary black diagram of the components used, according to some embodiments of the present invention.

DETAILED DESCRIPTION

In some embodiments, the trailers include their own OBUs and detecting the OBU of a trailer belonging to a specific vehicle OBU on the basis of an evaluation of the usual radio communication between radio beacons and OBUs would determine that the trailer is related to or is belonging to a vehicle. Then, on the basis of this detection, a trailer account belonging to the trailer OBU can be assigned to a vehicle account belonging to the vehicle OBU in a central system, for example. Accordingly, on the one hand, the trailer is not charged a toll as a separate vehicle and, on the other hand, the vehicle can be charged a toll as being fitted with a trailer. This constitutes an efficient and simple way of detecting vehicles with trailers that does not require either any complex axle counting systems or any fault-prone user inputs to an OBU. Since OBUs are inexpensive mass-produced articles, the double provision of OBUs fitted in vehicles and trailers is not of great significance compared to the known axle counting systems and considering the charge security that can be achieved by dispensing with user inputs.

No special positioning of the trailer OBU inside a road train consisting of a vehicle and a trailer is necessary for the method of the invention. Thus, the trailer OBU can be mounted both in the trailer itself and in the prime mover. The vehicle OBU and the trailer OBU are preferably both arranged next to one another in the vehicle, e.g. directly next to one another on the windscreen.

The distance measurement or localisation by means of radio beacons can be achieved in any manner known in the art. For example, the phase shift between the two radio communications may be utilised for measurement of the distance between the OBUs. Alternatively or additionally, the amplitude difference and/or Doppler shifts between the two radio communications can be utilised for measurement of the distance between the OBUs. In this case, preferably only radio communications within a given time window can be taken into consideration to increase evaluation reliability.

The method of the invention is suitable in particular for road toll systems according to the DSRC standard (dedicated short-range communication) in all the different technological embodiments, e.g. infrared, microwave at 5.8 GHz or 5.9 GHz etc. Accordingly, the radio beacons are preferably DSRC radio beacons and the OBUs are preferably DSRC OBUs, particularly preferred infrared- or microwave-based.

The evaluation can be conducted centrally in a central system and/or in a decentralised manner in a radio beacon or in a local control unit of the road toll system provided for multiple radio beacons, for example.

After detection of a pair of OBUs belonging together, toll accounts belonging to the OBUs can then be assigned to one another in the central system and/or the radio beacons. As a result, both toll accounts—that of the vehicle OBU and that of the trailer OBU—can be charged in parallel, for example, or—particularly preferred—only the toll account of the vehicle OBU can be charged. In the latter case, it is thus possible in a particularly simple manner to prevent trailer OBUs from being charged a toll as separate vehicles, while also ensuring that a trailer toll is charged to the vehicle toll account.

FIG. 1 is an exemplary block diagram of the components used, according to some embodiments of the present invention. As shown in FIG. 1, a road train 1 having a vehicle 2 and a trailer 3 is moving on a road 4 within a road toll system 5 that charges a toll for road use. The road toll system 5 comprises a plurality of roadside radio beacons 6, which can conduct short-range radio communications 7, 8 with radio OBUs (onboard units) 9, 10, which are carried by the road train 1. The radio communications 7, 8 are preferably conducted according to the DSRC standard.

Because of the known location of the radio beacons 6 and the limited range of their radio communications 7, 8, the OBUs 9, 10 can be located on the respective radio coverage regions of the radio beacons 6 and a charge can thus be made for use of the road 4. The radio beacons 6 also have a data connection to a central system 11, which manages toll accounts (OBU accounts) 13, 14 for the OBUs 9, 10 in a data bank 12. However, the toll accounts can also be managed in a decentralised manner, e.g. in computers on site at or in the radio beacons 6.

In some embodiments, the OBUs 9, 10 can be of a self-locating type, for example, by means of an in-built satellite navigation receiver, and transmit their positions to the radio beacons 6 via the radio communications 7, 8. In this case, the radio communications 7, 8 do not need to be of a locally limited range and could, for example, be mobile radio connections and the radio beacons 6 could be base stations of a mobile radio network, as is known in the art.

As shown in FIG. 1, the vehicle 2 and the trailer 3 are each assigned their own OBU 9, 10. Accordingly, the vehicle OBUs 9 also have their own vehicle accounts 13 and the trailer OBUs 10 have their own trailer accounts 14 in the data bank 12 of the central system 11 or the decentralised computers.

The trailer OBUs 10 can be mounted both in the trailer 3 itself and in the vehicle 2, e.g. directly next to the vehicle OBU 9 on the windscreen of the driver's cabin of the vehicle 2.

Since the two OBUs 9, 10 are each moving at a short and constant distance from one another in the road train 1, this circumstance can be determined by evaluating the physical parameters of the radio communications 7, 8. For example, the phase shift between the radio communications 7, 8 can be utilised for measurement of the distance between the OBUs 9, 10, and if this distance is less than a given maximum distance and does not change significantly over an observation period in the coverage region of a radio beacon 6, a vehicle OBU 9 and trailer OBU 10 pair that belong together can be deduced. Alternatively or additionally, the Doppler shift in the radio communications 7, 8 could be measured and the movement of the OBUs 9, 10 determined therefrom. If this occurs in the same direction and at the same speed, a pair of OBUs 9, 10 that belong together can again be deduced.

Alternatively or additionally, the physical proximity of two OBUs 9, 10 can also be deduced solely from the time coincidence of radio communications 7, 8, for example, if the vehicles are accordingly separated on the road 4 or the radio communications 7, 8 are completed in a very short time (as "burst"). Therefore, the passage of two closely adjacent OBUs 9, 10 could be deduced from two closely consecutive burst communications 7, 8.

After detection of a pair of OBUs 9, 10 belonging together, the associated vehicle and trailer accounts 13, 14 can then also be assigned to one another in the central system 11 or the decentralised computers of the beacons 6. As a result, e.g. both accounts 13, 14 can be charged in parallel or—particularly preferred—only the vehicle account 13 can be charged, which can prevent trailer OBUs 10 from being charged a toll as separate "vehicles", while also ensuring that the vehicle account 13 is charged with a trailer toll.

After detection of a pair of OBUs belonging together, the toll accounts assigned to the OBUs can then also be assigned to one another in the central system or the radio beacon. As a result, for example, both accounts—that of the vehicle OBU and that of the trailer OBU—can be charged in parallel or only the toll account of the vehicle can be charged. In the latter case it is possible to prevent trailer OBUs from being charged a toll as separate vehicles, while also ensuring that the vehicle toll account is charged with a trailer toll.

It will be recognized by those skilled in the art that various modifications may be made to the invention illustrated and any other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A method performed by one or more processors for detecting vehicles with trailers in a road toll system, which comprises at least one radio beacon for radio communication with radio onboard units (OBUs), the method comprising:

electronically associating a vehicle with a vehicle OBU carried by the vehicle, in a database;

electronically associating a trailer with a trailer OBU, in the database;

establishing radio communications between a radio beacon and said vehicle OBU, and between the radio beacon and said trailer OBU, via radio signals;

electronically evaluating said radio signals; and electronically detecting that said vehicle and said trailer are related to one another, when said evaluation of radio signals with the vehicle OBU and the trailer OBU indicates that said vehicle OBU and said trailer OBU are moving at a limited and constant distance from one another, wherein the radio beacons are DSRC radio beacons and the vehicle OBU and the trailer OBU are DSRC OBUs.

2. The method according to claim 1, wherein the vehicle OBU and the trailer OBU are both arranged next to one another in the vehicle.

3. The method according to claim 1, further comprising using a phase shift between the two radio communications for measurement of a distance between the vehicle OBU and the trailer OBU for said evaluation.

4. The method according to claim 1, further comprising using an amplitude difference between the two radio communications for measurement of the distance between the vehicle OBU and the trailer OBU for said evaluation.

5. The method according to claim 1, further comprising using a Doppler shift of the two radio communications for measurement of the movements of the vehicle OBU and the trailer OBU for said evaluation.

6. The method according to claim 1, wherein only radio communications within a given time window are taken into consideration for said evaluation.

7. The method according to claim 1, wherein the vehicle OBU and the trailer OBU are infrared-based or microwave-based DSRC OBUs.

8. The method according to claim 1, wherein said evaluation is conducted in a central system of the road toll system.

9. The method according to claim 1, further comprising electronically applying a charge to toll accounts assigned to said OBUs, when said vehicle and said trailer are detected to be related to one another.

10. The method according to claim 1, wherein said evaluation is conducted in a decentralised manner in a radio beacon of the road toll system, or in a local control unit of the radio beacon.

11. The method according to claim 1, further comprising applying a charge only to a toll account assigned to the vehicle OBU when vehicle and trailer OBUs are detected to be related to one another.

12. A method performed by one or more processors for detecting vehicles with trailers in a road toll system, which comprises at least one radio beacon for radio communication with radio onboard units (OBUs), the method comprising:

electronically associating a vehicle with a vehicle OBU carried by the vehicle, in a database;

electronically associating a trailer with a trailer OBU, in the database;

establishing radio communications between a radio beacon and said vehicle OBU, and between the radio beacon and said trailer OBU, via radio signals;

electronically evaluating said radio signals;

electronically detecting that said vehicle and said trailer are related to one another, when said evaluation of radio signals with the vehicle OBU and the trailer OBU indicates that said vehicle OBU and said trailer OBU are moving at a limited and constant distance from one another, wherein said evaluation is conducted in a decentralised manner in a radio beacon of the road toll system, or in a local control unit of the radio beacon.

13. The method according to claim 12, wherein the radio beacons are DSRC radio beacons and the vehicle OBU and the trailer OBU are DSRC OBUs.

14. The method according to claim 12, wherein the vehicle OBU and the trailer OBU are both arranged next to one another in the vehicle.

15. The method according to claim 12, wherein only radio communications within a given time window are taken into consideration for said evaluation.

16. The method according to claim 12, further comprising applying a charge to a toll account assigned to the vehicle OBU when vehicle and trailer OBUs are detected to be related to one another.

17. A method performed by one or more processors for detecting vehicles with trailers in a road toll system, which comprises at least one radio beacon for radio communication with radio onboard units (OBUs), the method comprising:

electronically associating a vehicle with a vehicle OBU carried by the vehicle, in a database;

electronically associating a trailer with a trailer OBU, in the database;

establishing radio communications between a radio beacon and said vehicle OBU, and between the radio beacon and said trailer OBU, via radio signals;

electronically evaluating said radio signals;

electronically detecting that said vehicle and said trailer are related to one another, when said evaluation of radio signals with the vehicle OBU and the trailer OBU indicates that said vehicle OBU and said trailer OBU are moving at a limited and constant distance from one another; and applying a charge only to a toll account assigned to the vehicle OBU when vehicle and trailer OBUs are detected to be related to one another.

18. The method according to claim 17, wherein the radio beacons are DSRC radio beacons and the vehicle OBU and the trailer OBU are DSRC OBUs.

19. The method according to claim 18, wherein the vehicle OBU and the trailer OBU are infrared-based or microwave-based DSRC OBUs.

20. The method according to claim 17, wherein said evaluation is conducted in a decentralised manner in a radio beacon of the road toll system, or in a local control unit of the radio beacon.

* * * * *